US007534297B2

(12) United States Patent
Hagman et al.

(10) Patent No.: US 7,534,297 B2
(45) Date of Patent: May 19, 2009

(54) SINGLE ITEM WORKFLOW MANUFACTURING SYSTEM AND METHOD

(75) Inventors: Thomas J. Hagman, Seattle, WA (US); Bruce N. Gilbert, Seattle, WA (US); Kenneth P. Zaballos, Burien, WA (US)

(73) Assignee: The Boeing Company, Chicago, IL (US)

( * ) Notice: Subject to any disclaimer, the term of this patent is extended or adjusted under 35 U.S.C. 154(b) by 581 days.

(21) Appl. No.: 11/108,780

(22) Filed: Apr. 19, 2005

(65) Prior Publication Data

US 2006/0233956 A1 Oct. 19, 2006

(51) Int. Cl.
*B05C 13/02* (2006.01)

(52) U.S. Cl. ..... 118/66; 118/423

(58) Field of Classification Search ..... 118/66, 118/423, 425, 503; 198/465.4, 468.6, 750.14; 204/269

See application file for complete search history.

(56) References Cited

U.S. PATENT DOCUMENTS 4,379,031 A * 4/1983 Krotkiewicz et al. ..... 205/100
6,345,635 B2 * 2/2002 Lachmann et al. ..... 134/76
6,699,329 B2 * 3/2004 Mueller et al. ..... 118/641

OTHER PUBLICATIONS http://www.pfonline.com, "Adding a Second Electrocoating Line: a second electrocoating line doubled the capacity for coating clutches . . . ", published Mar. 1, 1998, pp. 1-3.

* cited by examiner

*Primary Examiner*—Brenda A Lamb

(57) ABSTRACT

In a system for coating a plurality of items, a tank unit prepares the plurality of items for painting, a painting unit paints the plurality of items, a drying unit dries the plurality, and an item conveyer conveys the plurality of items through the system as a flow of single items.

12 Claims, 7 Drawing Sheets

SINGLE ITEM WORKFLOW MANUFACTURING SYSTEM AND METHOD

FIELD OF THE INVENTION

The present invention generally relates to the manufacture of items. More particularly, the present invention pertains to a device and system for manufacturing items in a single piece workflow and a method of use.

BACKGROUND OF THE INVENTION

The manufacture of items generally involves a multitude of steps or processes to take the item or part from raw materials to finished part. The particular processes vary from one industry to the next and according to the materials used. However, there are some processes that cut across multiple industries. For example, forming, preparation, and finishing processes are typically utilized in the manufacture of plastic and metal items. In addition, each process typically entails more than one step. More specifically, finishing includes processes such as cleaning, de-greasing, etching, deoxidizing, reducing, painting, chemical deposition, and/or the like. These processes are similar in that they generally involve immersing or otherwise coating a fabricated part in a solution or chemically reactive solution. Typically, a large batch of parts is dipped into a tank, held in the tank for some length of time and then moved to a rinse tank or another tank of some other chemically reactive solution.

A disadvantage associated with conventional metal part fabrication is that parts are processed in a "batch and queue" manner. That is, some steps involve machines that lend themselves to single item workflow, while other steps require batch processing. Thus, parts queue up as they are processed one or a few at a time when the following steps are preformed in great batches. For example, conventional chemical processing and painting systems are generally designed for batching hundreds or thousands of parts through the process. In addition, chemical processing tanks are typically located in a separate facility away from the fabrication process. The tanks are typically large, e.g. a 20,000 gallon capacity, and do not lend themselves to producing a flow of single work pieces. These and other factors lead to large investments of time and materials prior to the production of a first part. Lead time between batches is also quite large and, if a faulty batch is produced or production is stopped while a batch is in process, a great amount of materials will be wasted.

Accordingly, it is desirable to provide a device and system for manufacturing items and a method of use that is capable of overcoming the disadvantages described herein at least to some extent.

SUMMARY OF THE INVENTION

The foregoing needs are met, to a great extent, by the present invention, wherein in some embodiments a device and system for finishing items and a method of use is provided.

An embodiment of the present invention relates to a system for coating a plurality of items. The system includes a tank unit to prepare the plurality of items for painting, a painting unit to paint the plurality of items, a drying unit to dry the plurality, and an item conveyer to convey the plurality of items through the system as a flow of single items.

Another embodiment of the present invention pertains to an apparatus for coating a plurality of items. The apparatus includes a tank unit to prepare the plurality of items for painting, a painting unit to paint the plurality of items, a drying unit to dry the plurality, and an item conveyer to convey the plurality of items through the system as a flow of single items.

Yet another embodiment of the present invention relates to a method of coating a plurality of items. In this method, the plurality of items is chemically prepared for painting, the plurality of items are painted and dried, and the plurality of items are conveyed through the system as a flow of single items.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides, in some embodiments, an item manufacturing system and a method of manufacturing items. In an embodiment, the invention provides an item manufacturing system for manufacturing various items or parts. Advantages of certain embodiments of the item manufacturing system include one or more of: processing a flow of single items; portability; flexibility, use with existing power supply; and the like. As a result of these advantages, the item manufacturing system may generate a finished item from raw materials in a relative compact space and in a relatively short amount of time as compared to conventional manufacturing systems.

In addition, the item manufacturing system is readily adaptable to changes in processing procedures. In this regard, manufactured items or parts are often chemically processed to improve certain characteristics of the item. Examples of characteristics improved by chemical processing include: wear resistance; resistance to corrosion; surface hardness; coating adhesion; and the like. Depending upon the particular processing being performed, the item is subjected to one or more chemical solutions for a predetermined amount of time and at a predetermined temperature. Due to the flexibility and portability of subunits that make up the item manufacturing system, the item manufacturing system may be reconfigured with comparative ease. For example, if, during production, an additional chemical treatment of the item becomes necessary, an additional chemical processing subunit of the item manufacturing system may be integrated. In a conventional system, such a change may require comparatively major re-design and re-tooling.

In addition, chemical processing may be utilized to prepare an item for painting or other finishing steps. An example of a suitable chemical processing of aluminum items includes Alodine 600 conversion coating. Alodine is an oxide layer on the surface of an aluminum item where the oxide crystals form an organized structure of tightly packed hexagonal columns. This provides a surface to which BMS 10-11 zinc chromate primer can readily adhere. Several steps are taken to prepare the aluminum surface for the application of Alodine. These steps optionally include a degreasing operation, alkaline cleaning, and nitric acid etch to remove the oxide layer which naturally forms on aluminum in air. A rinse is typically performed after each cleaning and etching process. The result is a clean, and substantially oxide-free part ready for Alodine. After Alodine is applied, the item is rinsed and dried.

Figure 1:
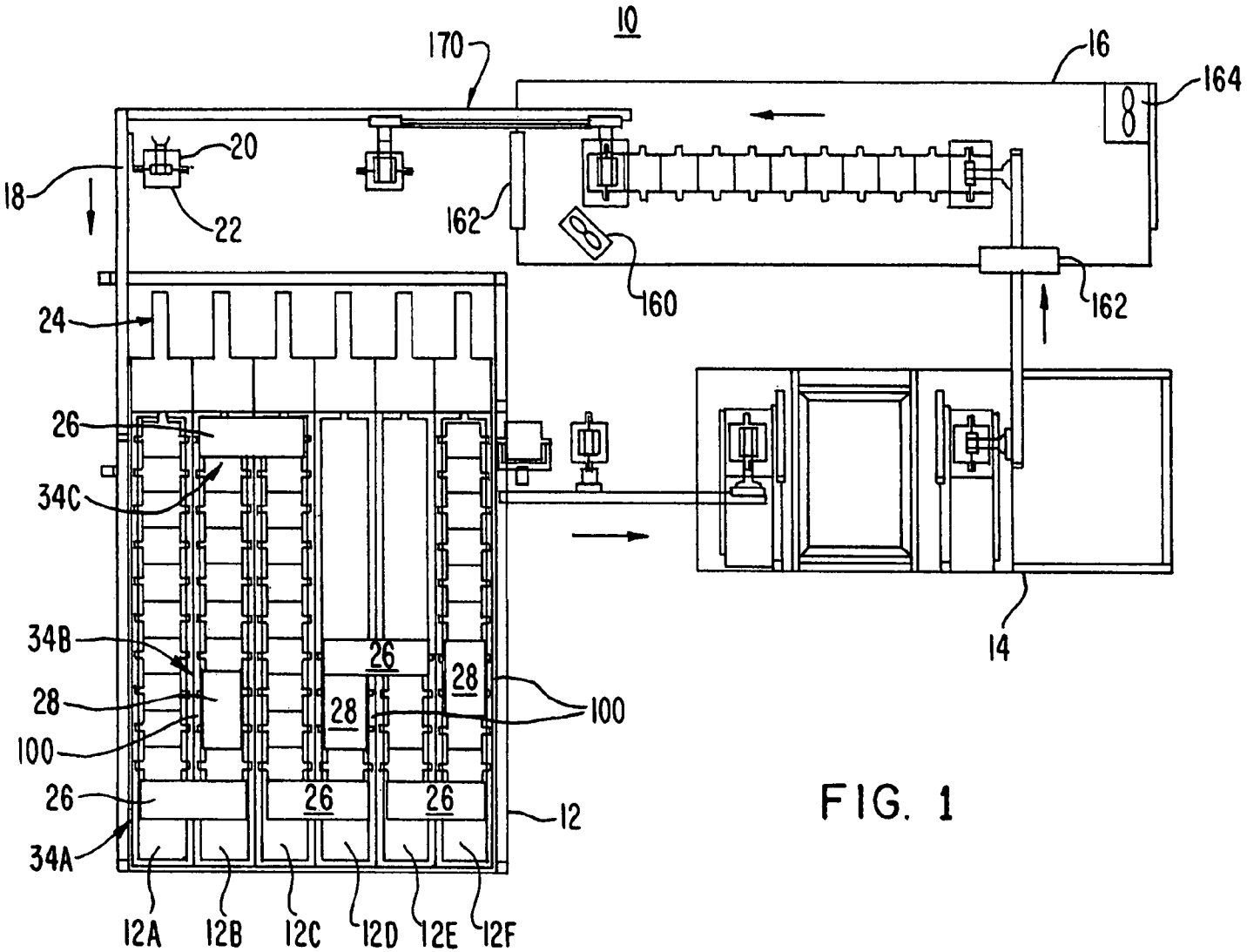
FIG. 1 is block diagram of a finishing system according to an embodiment of the invention.

The invention will now be described with reference to the drawing figures, in which like reference numerals refer to like parts throughout. As shown in FIG. 1, an item finishing system 10 includes four major components: a tank line 12; painting unit 14; curing oven 16; and item conveyer system 18 that moves a plurality of items 20 through each of the components, and between them.

In various embodiments, the tank line 12 cleans, degreases, chemically and/or electrochemically etches and/or coats the items 20 as appropriate. In a particular embodiment, the tank line 12 includes a plurality of tanks 12A-12F. The bottoms of one or more of the tanks 12A-12F are slanted to aid in draining. Each of the tanks 12A-12F is configured to contain a solution such as, for example, cleaning solution, acid, Alodine, rinse solution, and the like. Moving the items 20 through the tank line 12 cleans the items 20 using a heated alkaline clean solution, then a first and second water rinse, then a deox solution of nitric and chromic acid, another first and second rinse, then Alodine conversion coating, and a warm rinse, then a warm air dry. The items 20 are then transferred, each in its turn, to the painting unit 14 where they are painted or otherwise coated. In a particular example. The items 20 are dipped twice in a specially controlled paint solution and the solvent is allowed to flash-off for several minutes. The items 20 are conveyed to a paint curing oven 16 to cure the coating to the item 20.

In general, one of the items 20 enters the item finishing system 10 and a finished one of the items 20 leaves the item finishing system 10 each predetermined increment of time. The predetermined increment of time includes any suitable time increments such as, for example 10 seconds, 1 minute, 5 minutes, 15 minutes, and the like. Time increments may be based upon path length of the finishing system 10, duration of individual processes, manufacturer's specifications, empirical data, and the like. In a particular example, the time increment is one minute. That is, one item 20 enters the system and one finished item 20 leaves the system every 60 seconds. Each item 20 is hung from an item carrier 22 and moved through the item finishing system 10 via the item conveyer system 18. FIG. 1 illustrates the flow of items 20 through the tank line 12. More particularly, the item conveyer system 18 includes a variety of material-handling devices that move the item carriers 22 through the tank line 12, painting unit 14, and curing oven 16. Specific examples of material-handling devices include a walking beam device 24, tank transfer device 26, and weir hop device 28. The walking beam device 24 moves the item carriers 22 along the length of each tank 12A-12F. The tank transfer device 26 lifts the item carriers 22 and transfer them to adjacent tanks 12A-12F. The weir hop device 28 moves the item carriers 22 over weirs or dividers in the tanks 12A-12F.

Figure 2:
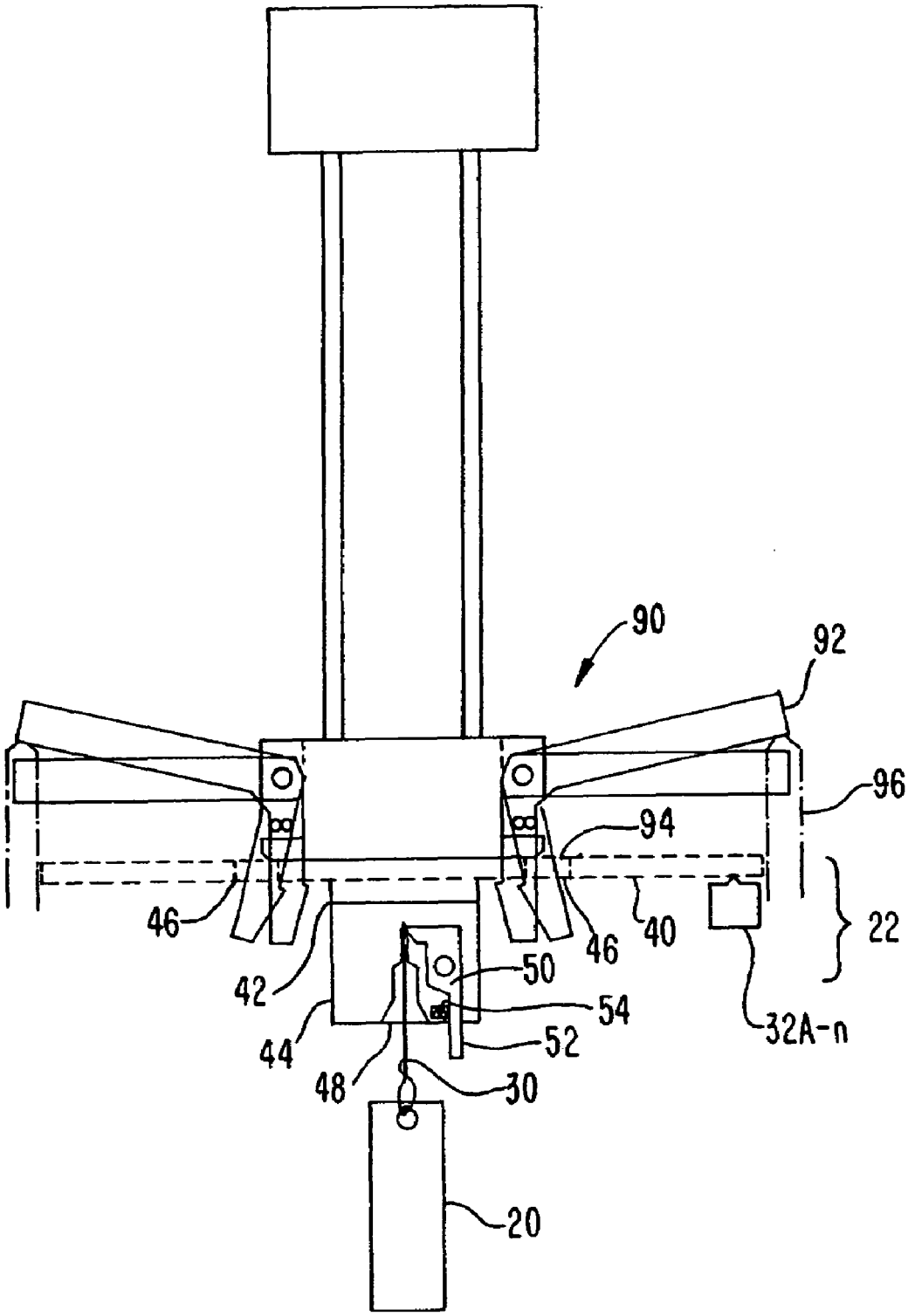
FIG. 2 is simplified view of a gripper device engaging an item carrier suitable for use with the system of FIG. 1.

As shown in FIG. 2, to attach each item 20 to its respective item carrier 22, a connector 30 is utilized. In general, the connector 30 includes any suitable device to attach the item 20 to the item carrier 22. Examples of suitable attaching devices include wire or mesh baskets, clips, wires, and the like. In a particular example, the connector 30 includes an aluminum wire. This wire is optionally threaded through a hole, if present, in the item 20. The other end of the wire is releasably attached to the item carrier 22 via a bracket or gripper device. In another example, a basket is suspended from the item carrier 22 and the item 20 is placed in the basket. An advantage of the wire is that a minimum amount of solution is transferred from one tank 12A-12F to another by the wire due to the relatively minimal amount of surface areas as compared to a basket or clip. An advantage of the basket is that it securely retains the item 20 and the basket facilitates retaining items that lack a hole.

As shown in FIGS. 1 and 2, the item finishing system 10 optionally includes a plurality of position sensors 32A-32*n* to sense the respective positions of the item carriers 22. For example, the item finishing system 10 includes a plurality of pickup stations 34A-34*n* where ones of the item carriers 22 are attached to and moved by the various components of the item conveyer system 18. At each or some of the pickup stations 34A-34*n*, respective ones of the plurality of position sensors 32A-32*n* are utilized to sense that the item carrier 22 is in the correct position for pickup. Advantages of at least some embodiments of the item finishing system 10 that: output from the position sensors 32A-32*n* is utilized to determine if one of the items 20 has been loaded into the item finishing system 10; the respective locations of the items 20 are tracked as they proceed through the item finishing system 10; the item finishing system 10 is configured to automatically shut down when the last item 20 is processed; and the painting unit will not cycle if one of the items 20 is not present. In other embodiments, additional sensors are configured to sense if the item 20 is hanging correctly; i.e., not up too close to the item carrier 22, not down hanging down too low, and not tilted to the side.

As shown in FIG. 1, the item carriers 22 includes a plate 40, insulator 42, and receptacle 44. The plate 40 includes an interface 46 for the components of the item conveyer system 18 to attach to. In addition, the plate 40 is configured to cover a portion of the tank line 12 and further configured to abut the plate 40 of adjacent item carriers 22. In this manner, the item carriers 22 facilitate covering the tank line 12 and thereby reduce evaporation. The insulator 42 is disposed between the plate 40 and the receptacle 44 and electrically isolates the item 20 from the tanks 12A-12F. The receptacle 44 is configured to mate with the connector 30. In a particular example, the receptacle 44 includes a chamfered hole 48 and spring loaded pawl 50 configured to receive an end of the connector 30 and grasp the connector 30 firmly. The receptacle 44 further includes a release 52 to disengage the spring loaded pawl 50 and thereby release the connector 30. The release 52 is biased in the closed position by a spring 54.

Figure 3A:
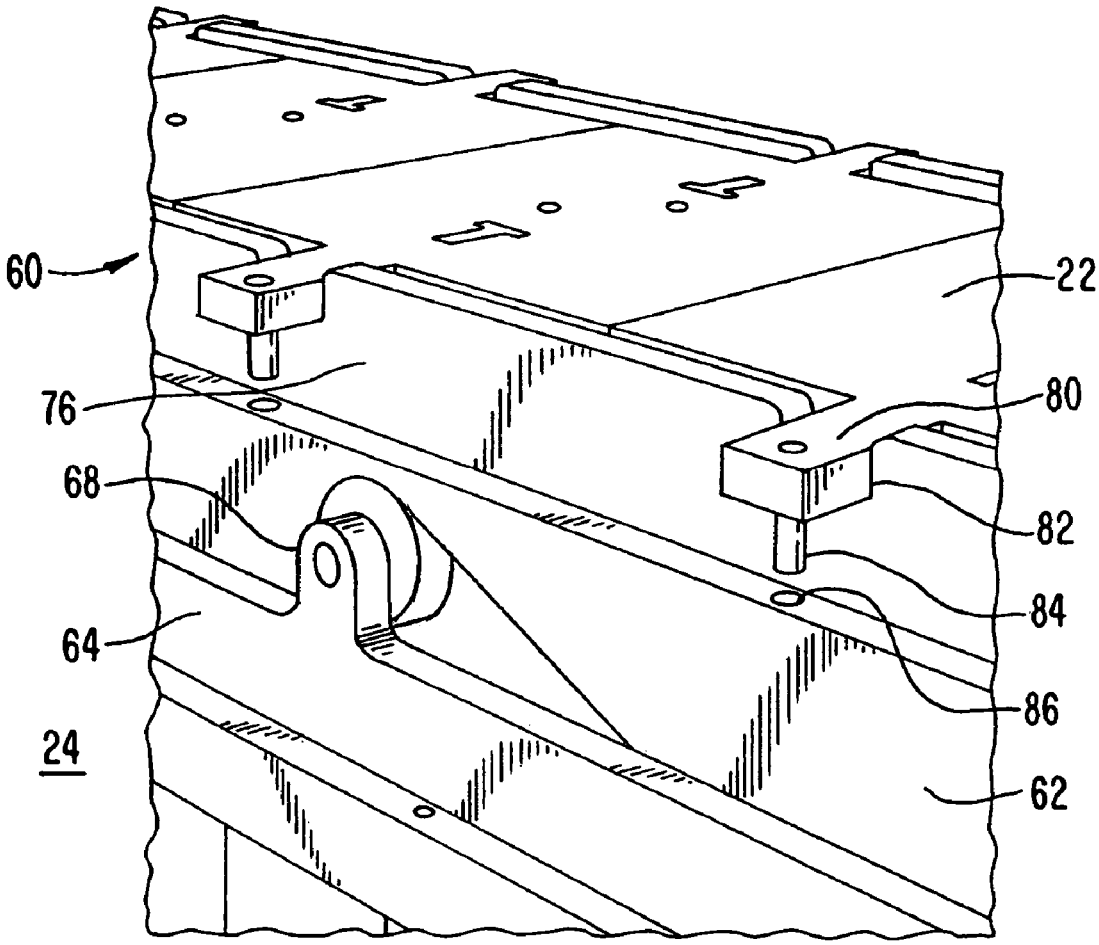
FIG. 3A is a perspective view of a walking beam assembly suitable for use with the system of FIG. 1.
Figure 3B:
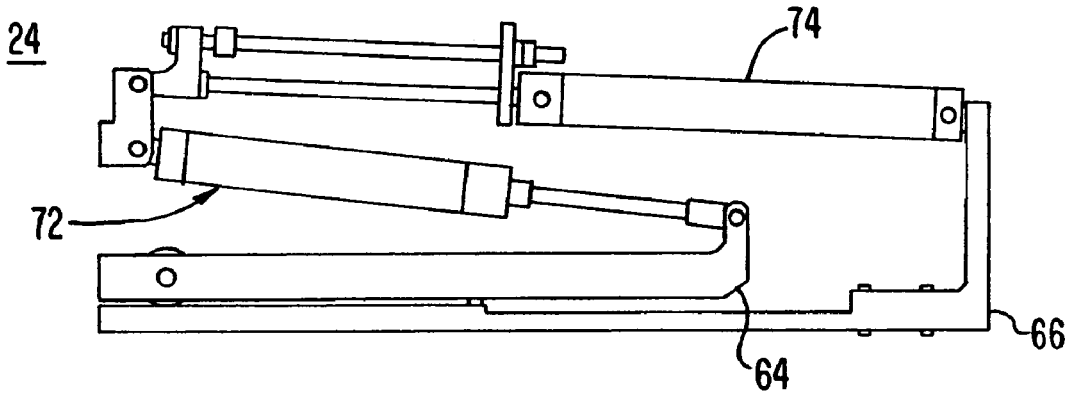
FIG. 3B is a detailed side view of actuators for the walking beam assembly suitable for use with the system of FIG. 1.
Figure 3C:
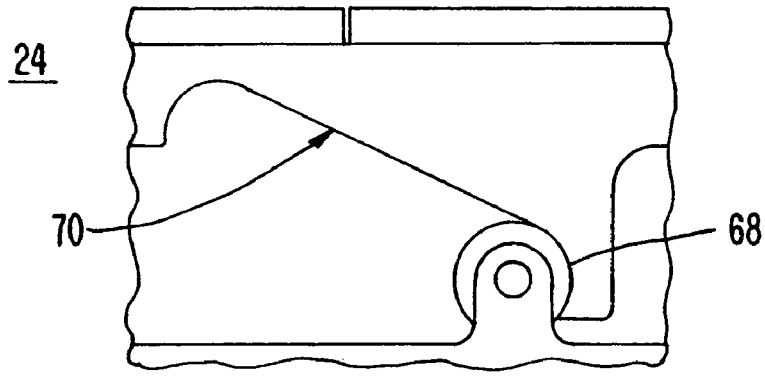
FIG. 3C is a detailed side view of a cam profile for the walking beam assembly suitable for use with the system of FIG. 1.

As shown in FIGS. 3A-3C, the walking beam device 24 is a mechanism that moves individual and/or groups of the items 20 in a pulsing fashion along a predetermined path at essentially uniform intervals. The walking beam device 24 lifts the items 20, via the item carriers 22, off a stationary holding fixture 60, shifts them one pitch and sets them back down on the holding fixture 60. The walking beam device 24 includes a transfer rail assembly 62, roller frame assembly 64, deck assembly 66, cam followers 68, lift cylinder 72, shift cylinder 74, and step rail 76. The transfer rail assembly 62 holds the item carriers 22 when lifted and shifted during the walking sequence. The roller frame assembly 64 rolls on the deck assembly 66 and carries the cam followers 68 that facilitate an up and down motion of the transfer rail assembly 62. More particularly, the cam followers 68 are configured to mate with a plurality of respective cam profiles 70 formed in the transfer rail assembly 62 such that, when the lift cylinder 72 is extended, the roller frame assembly 64 moves horizontally causing the transfer rail assembly 62 to move vertically. When the shift cylinder is retracted, both roller frame assembly 64 and transfer rail assembly 62 move horizontally and thereby progress the item carriers 22 one interval along the walking beam device 24. In a particular example, the lift cylinder 72 includes a 1.0625-inch diameter piston and 0.3125-inch diameter shaft. The lift cylinder 72 delivers approximately 70 pounds of force when supplied 80 pounds per square inch of gas pressure. The mechanical advantage of the cam shape enables the lift cylinder 72 to "lift" up to about 140 pounds. In other embodiments, the lift cylinder 72 has less or more capacity as appropriate for the system.

When the lift cylinder 72 is retracted, the item carriers 22 rest upon the step rail 76. More particularly, one or more tabs 80 on the item carrier 22 engage respective notches 82 in the step rail 76. The step rail 76 is stationary and is attached to the deck assembly 66. Optionally, the tabs 80 include pins 84 directed downward from the tabs 80 and configured to engage respective bores 86 disposed within the transfer rail assembly 62. When the lift cylinder 72 is extended, the pins 84 go into the bores 86 and thereby positively located the item carriers 22 upon the transfer rail assembly 62. This provides a predictable location of the item carriers 22 and less potential for the item carriers 22 to slide or tip. The various components of the walking beam device 24 are constructed from any suitable relatively strong, corrosion resistant, and dimensionally stable material. Suitable materials include 304 and/or 316 stainless steel. Suitable materials for any rolling elements also include SAE 660 bronze.

Returning to FIG. 2, the item conveyer system 18 includes a passive gripper device 90 to transfer the items 20, via the item carriers 22, from one tank 12A-12F to another tank 12A-12F, over any optional weirs within a tank 12A-12F, and from one unit of the item finishing system 10 to another. The passive gripper device 90 includes one or more spring loaded pawls 92 that snap into corresponding slots 94 that are disposed in the item carriers 22. The passive gripper device 90 further includes an actuating pin 96 that releases the item carriers 22. The passive gripper device 90 is referred to as passive because it does not require sensors or an actuating device. However, in other embodiments, the gripper device 90 includes sensors and/or actuators to grasp and release the item carriers 22. To continue, as the empty passive gripper device 90 is lowered toward the item carrier 22, the spring loaded pawls 92 snap into the corresponding slots 94. When the passive gripper device 90 is raised, the item carrier 22 is lifted up. As the item carrier 22 is lowered toward the walking beam device 24, horizontal extensions on the spring loaded pawls 92 contact the actuating pin 96 which cause the spring loaded pawls 92 to rotate and release the item carrier 22 onto the walking beam device 24. These actuating pins 96 are located adjacent to drop off locations for the item carrier 22, and are not present at pick up locations for the item carrier 22.

Optionally, one or more of the tanks 12A-12F include a weir 100 (shown in FIG. 1) to divide one part of the tank 12A-12F from another. For example, the tank 12B includes the weir 100 to divide the tank 12B into a first and second rinse tank. To advance the items 20 from the first to the second rinse tank, the items 20 "hop" over the weir 100. That is, the weir hop device 28 attaches to the item carrier 22 via the passive gripper device 90 and the item carrier 22 is raised, advanced past the weir 100 and lowered upon the walking beam device 24. In a similar manner, the tank transfer device 26 attaches to the item carrier 22 via the passive gripper device 90 and the item carrier 22 is raised, advanced to the next tank 12A-12F and lowered upon the walking beam device 24. The tank transfer device 26 and weir hop device 28 employ any suitable actuator or system of actuators to raise, move, and lower the item carriers 22. In a particular example, suitable actuators include those manufactured by Robohand Inc. of Monroe, Conn. 06468, USA.

In an embodiment, the item finishing system 10 includes a variable timing feature. For example, as the Alodine solution ages, soaking times are increased. The item finishing system 10 is configured to accommodate this increase in the soak times by included an independent tank transfer device 26 over the Alodine tank 12E. When the solution is new, the tank transfer device 26 is configured to remove the item carrier 22 relatively quickly as compared to when the solution ages.

Figure 4:
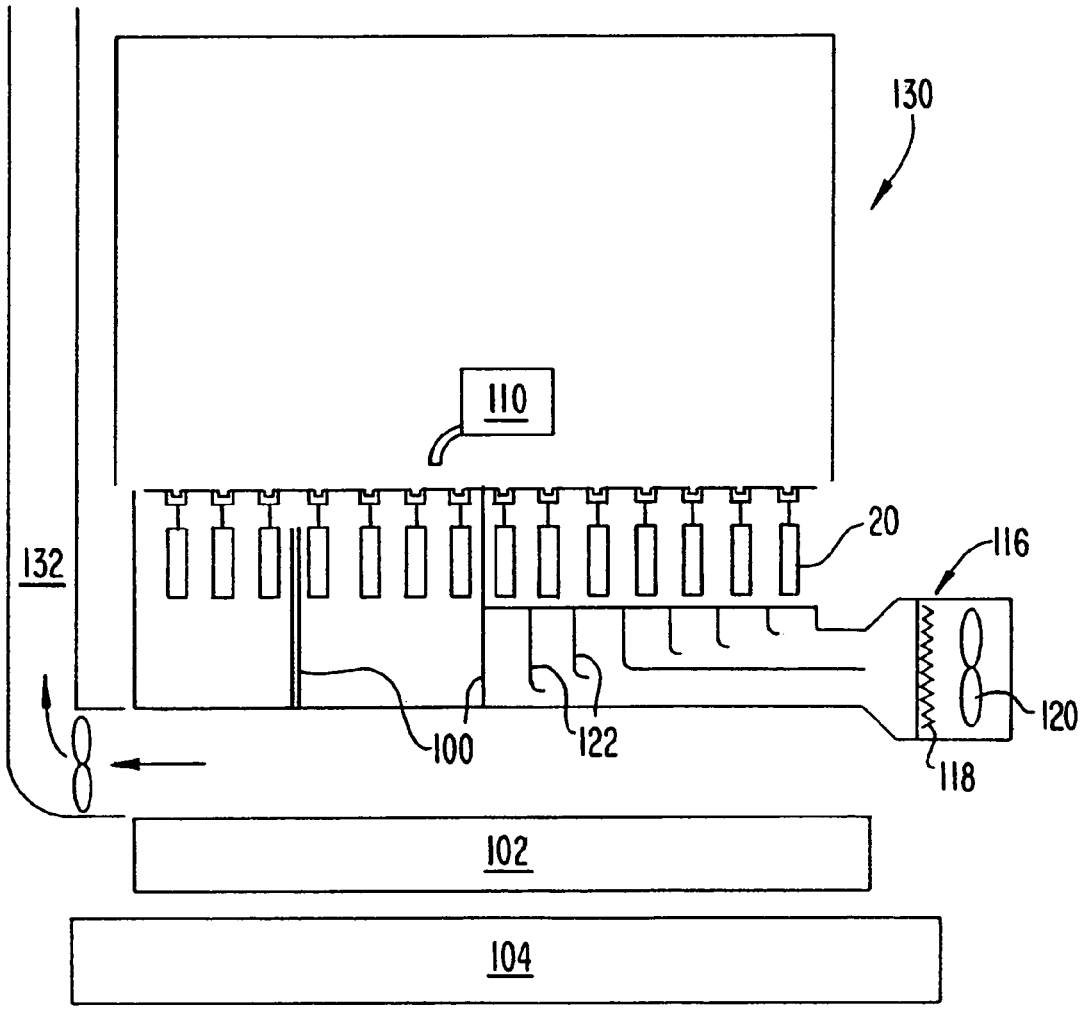
FIG. 4 is a simplified side view of a rinse tank and dryer suitable for use with to the system of FIG. 1.
Figure 5:
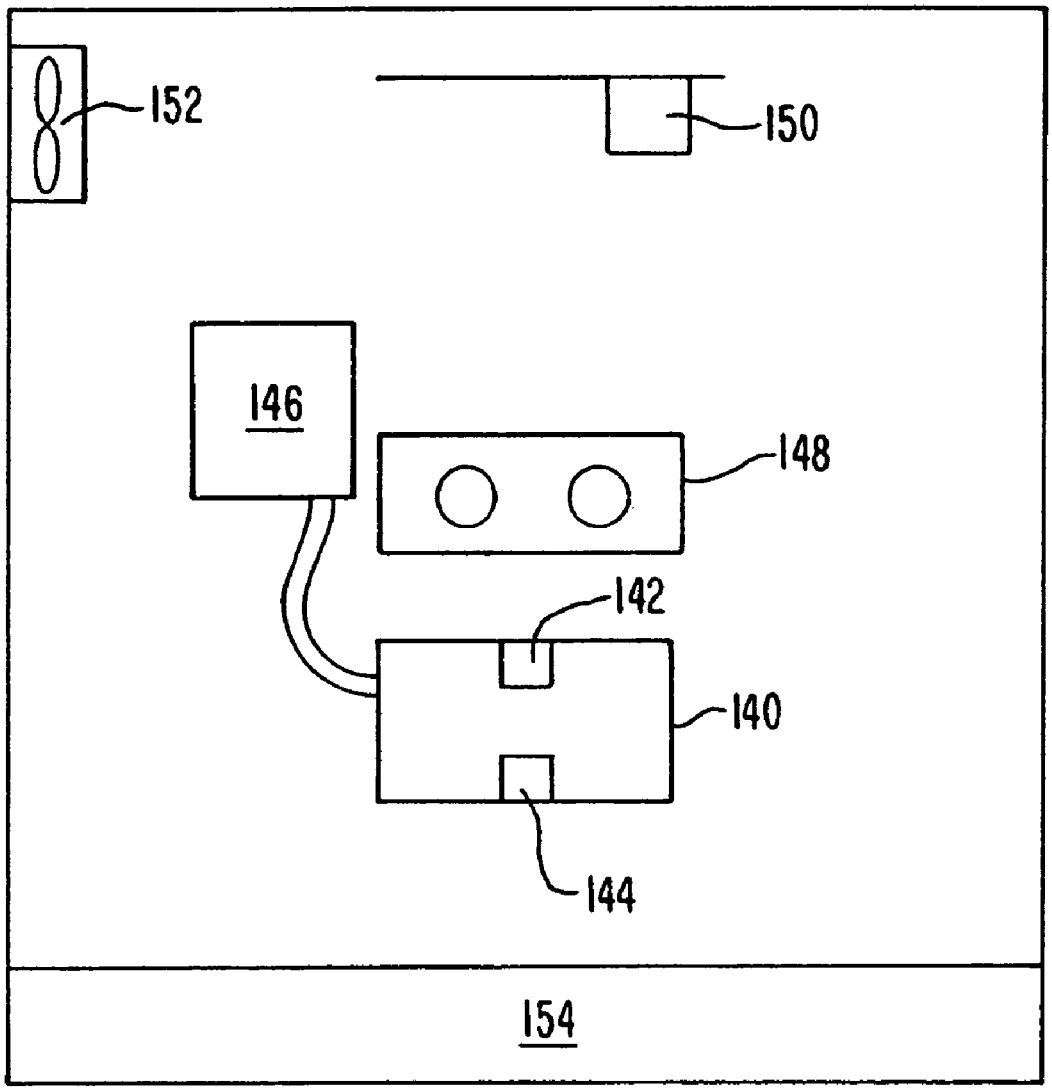
FIG. 5 is a diagram of a system architecture for a painting unit suitable for use with the system of FIG. 1.

As shown in FIG. 4, the tank line 12 optionally includes a collection basin 102 disposed below the tank line 12 and a secondary containment tray 104 disposed below and outside the tank line 12 and the collection basin 102. The secondary containment tray 104 is optionally disposed on top of a pallet 106 to facilitate moving the tank line 12. These components of the tank line 12 are manufactured from any suitable material. Suitable materials include rigid plastics and composites and metals. Preferably, the materials are essentially non-reactive. Particular examples of suitable materials include ⅛" type 304 stainless steel, 316L stainless steel, and the like. In various embodiments, the tank line 12 further includes an access area to fill, agitate, drain, and clean the tanks 12A-12F. Optional heaters are included to heat solutions as suitable.

In addition, the tank line 12 optionally includes a rinse fluid supply 110 to supply rinse fluid at a controlled rate. In some ,embodiments, one or more of the tanks 12A-12F are configured to rinse solutions from the items 20. If present, the rinse fluid supply 110 adds rinse fluid to the tanks 12B, 12D, and 12F and any excess flows over the edge of the tank, through an opening or through a stand pipe welded through the tank bottom to the collection basin 102 below. The rinse tanks 12B, 12D, and 12F with a first and second rinse have the rinse fluid supplied to the second rinse portion; this fluid drains over the weir 100 separating the two portions; rinse fluid subsequently drains to the collection basin 12. That is, the items 20 are moved through the tanks 12B, 12D, and 12F in a direction opposite to the rinse fluid flow. The rinsed items 20 are removed from the portion of the tank 12B, 12D, and 12F containing the cleanest rinse fluid, thereby maximizing the cleaning efficiency. In an embodiment, the rinse fluid supply 110 is a separate supply tank. In another embodiment, the rinse fluid is supplied from a supply line. Utilizing a separate supply tank includes the advantage of minimizing instances of unrestricted overflow. For example, a 30-gallon polyethylene rinse water storage tank with one or more adjustable flow rate metering pumps provides controlled flow rates and limits spills to about 30 gallons or less.

In an embodiment, the items 20 are dried following chemical processing and prior to being painted. In this embodiment, the tank line 12 includes a dryer 116 that directs a heated air flow towards the items 20. The dryer 116 includes a heater 118 and a blower 120 to induce a flow of heated air and a plurality of louvers 122 to direct this flow of heated air. To further reduce drying time, the rinse tank 12F is optionally heated.

To reduce fumes in the vicinity of the tank line 12, the tank line 12 optionally includes an enclosure 130 and ventilation system 132. The enclosure 130, if present is constructed of a planar and essentially gas impermeable material. In a particular example, the enclosure 130 includes Lexan® panels and doors that are detachably secured about the tank line 12 and provide access to and from the tank line 12. The ventilation system 132 draws air and fumes from the enclosure 130. In a particular example, the ventilation system draws air and fumes downward from between and around the tanks 12A-12F. Supply air is provided by an item entrance and item exit openings in the and/or from slit openings along the top of the sides of the enclosure 130.

In various embodiments, the painting unit 14 sprays and/or dip paints or coats the items 20. In a particular embodiment, the painting unit 14 includes a container 140 to contain the paint. Depending upon the specifications for the item 20 and/or the paint, the item 20 may be dipped 1, 2, 3, or more time. In instances where the item 20 is to be dipped two times, the container 140 is configured to facilitate dipping two of the items 20, side by side. In this manner, the item 20 is dipped at a first position in the container 140, withdrawn from the container 140, advanced, and dipped at a second position in the paint container 140. When the item 20 is being dipped at the first position, a preceding item 20 may be dipped at the second position and while the item 20 is being dipped at the second position, a subsequent item 20 may be dipped at the first position. In this manner, the flow of items 20 through the painting unit may proceed efficiently and without delay. The paint container 140 is further configured to facilitate the use of a paint mixer 142, viscometer 144, and solvent supply 146. Following painting, the items 20 remain in the painting unit 14 sufficiently long enough for solvent to "flash off" and thereby reduce or substantially prevent the paint from blistering in the curing oven 16. For example, depending upon the solvent, the temperature of the painting unit 14, and the like, a flash off time of 10 minutes is sufficient to substantially prevent the paint from blistering. The viscometer 144 senses the viscosity of the paint. In response to the sensed viscosity of the paint, the solvent supply 146 is controlled to add solvent to the paint container 140. In a particular example, the paint mixer 142 includes a propeller-like mixing device disposed near the center of the paint container 140. Depending upon the solvent utilized in the paint, the paint mixer 142 is preferably operated by a pneumatic motor to avoid the hazards presented by running an electric motor in a solvent vapor atmosphere.

The painting unit 14 optionally includes an air knife 148. The air knife 148 directs a cone of air towards the item 20 as it is being withdrawn from the paint container 140. This air flow generates an air impingement that substantially prevents beads of paint from clinging to edges of the item 20. In a particular embodiment in which the items 20 are dipped twice, the air knife 148 includes a double circular configuration disposed on top of the container 140. In a particular embodiment, the item 20 is quickly lowered into the container 140 until submerged. The item 20 is withdrawn relatively more slowly than dipped. Preferably, the rate at which the item 20 is withdrawn is substantially constant.

To advance the items 20 through the painting unit 14, the item conveyer system employs the walking beam device 24 and a dipping actuator 150 configured to raise the item 20 over the container 140 and air knife 148. The walking beam device 24 is mounted to a support frame of the painting unit 14. The dipping actuator 150 includes a ball screw assembly driven by a servomotor, a reversing ball screw powered by a pneumatic gear motor, or other such suitable actuator. Suitable actuators include those that move at a controlled and consistent speed. In a particular example, the dipping actuator 150 is configured to move down about 15 inches in about 3 seconds and move back up in about 30 seconds. Depending upon the solvent utilized in the paint, the dipping actuator 150 includes an motor or other such actuator suitable for use with the solvent and/or the motor is substantially isolated from the solvent vapors. The length of the walking beam 24 is at least partially based upon the amount of time to flash off the solvent. For example, if each pitch of the walking beam device 24 is 6 inches and steps are performed once a minute, the walking beam device 24 is 5 feet long to achieve a ten minute flash off time.

Optionally, the painting unit 14 includes a ventilation system 152 to facilitate the removal of solvent vapors. In instances where the solvent is water or another essentially harmless solvent, the ventilation system 152 may be omitted. In other instances, the ventilation system 152 is configured to remove the vapors from the painting unit 14. In particular, the ventilation system 152 is configured to maintain the vapor level below a lower explosive limit for the particular solvent.

The painting unit 14 optionally includes a secondary containment system 154 to contain spilled and/or unused paint. Preferably, unused paint is transferred from the container 140 to the secondary containment system 154 within the confines of the painting unit 14 to minimize solvent vapors outside the painting unit 14.

Returning to FIG. 1, the curing oven 16 includes the walking beam device 24 to advance the items 20 therethrough. The curing oven 16 is configured to maintain a predetermined temperature suitable to cure the paint on the items 20. In a particular example, the predetermined temperature is 93° C. (200° F.). Other suitable temperatures, depending upon the paint system utilized, includes 82° C. (180° F.), 121° C. (250° F.), 149° C. (300° F.), and the like. In addition, the length of the curing oven 16 is configured to house a suitable number of the items 20 and keep these items 20 at the predetermined temperature for a suitable length of time (cure cycle). For example, given a pitch length of 6 inches and a step cycle of 1 minute, the length of the curing oven 16 is at least 5 feet long to achieve a cure cycle of 10 minutes. In other instances, the curing oven 16 is longer or shorter or includes a serpentine path therethrough to facilitate different curing cycles in response to the use of different paint systems.

The curing oven 16 optionally includes a recirculation fan 160 to generate a recirculating airflow. In a particular example, the recirculation fan 160 generates about 1700 cubic feet per minute ("CFM") of recirculation airflow. In general, the recirculation fan 160 is to generate a horizontal airflow around the items 20. The curing oven 16 optionally includes one or more automatic doors 162 for the items 20 to enter and exit the curing oven 16. If present, the automatic doors 162 are configured to reduce heat loss and/or contain vapors. The curing oven 16 optionally includes an exhaust fan 164. If present, the exhaust fan 164 is configured to remove some portion of vapor laden air from the curing oven 16. For example, the exhaust fan 164 is configured to turn on in response to the vapor content of the air in the curing oven 16 exceeding a predetermined maximum vapor content. In a particular example, the exhaust fan 164 includes a 68 CFM blower controlled via a vapor sensor.

Figure 6:
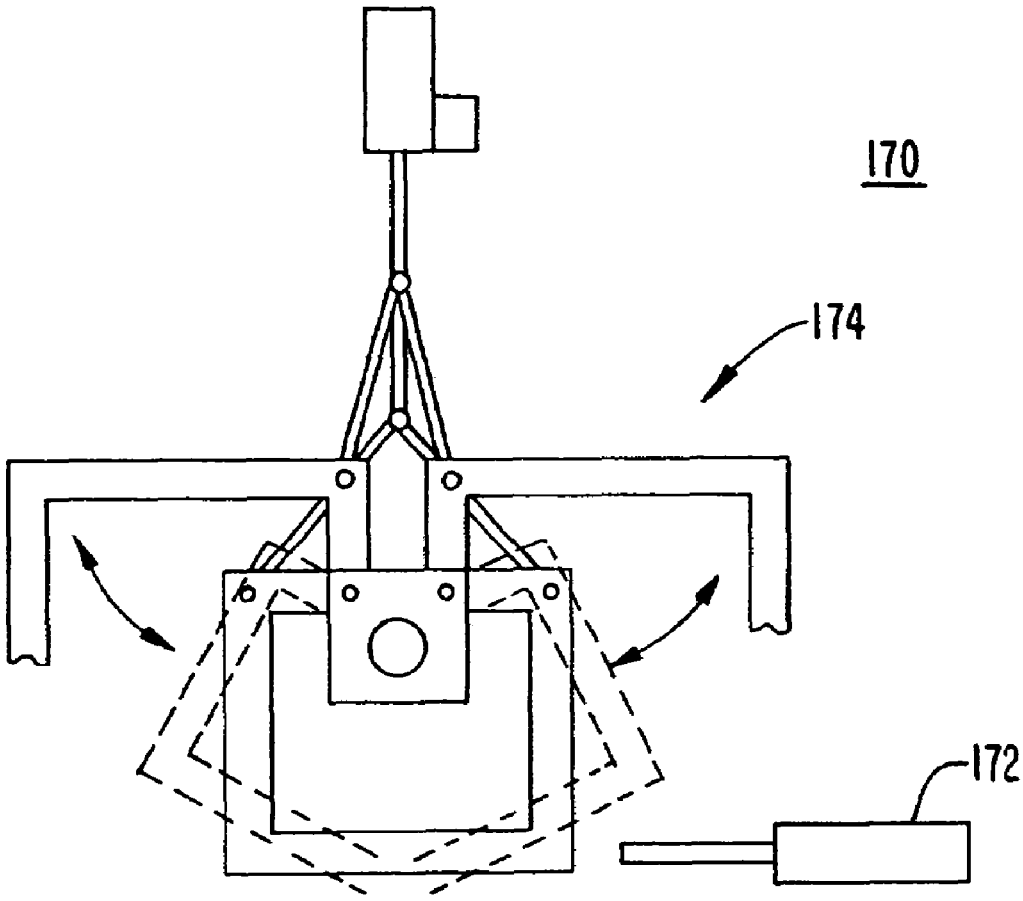
FIG. 6 is a simplified top view of an unloading station suitable for use in the system of FIG. 1.

Following curing, the items 20 are conveyed to another station or unloaded from the item carrier 22. For example, the items 20 are collected, conveyed to a device for further processing or conveyed directly to a construction line for integration into a device such as an airplane. As shown in FIG. 6, the item finishing system 10 optionally includes an unloading station 170 to disengage the items 20 from the item carriers 22. If present, the unloading station 170 includes the passive gripper device and one or more actuators to remove the item carrier 22 from the curing oven 16. The unloading station 170 optionally includes an item release actuator 172 to remove the item 20 from the item carrier 22. In this manner, the item 20 is deposited in a collection bin or conveyer system depending upon the configuration of the item finishing system 10.

In a particular example, the release actuator 172 is configured to press the release 52. The unloading station 170 also optionally includes a gripper device 174 configured to serve a dual purpose. The gripper device 174 is configured to close above the item 20 after the item 20 has been released. If no obstruction is encountered (e.g., the connector 30 and item 20 have been released), the gripper device 174 is configured to open. If an obstruction is encountered (e.g., the connector 30 is not released), the gripper device 174 will clamp against the connector 30, in a particular example, a wire, and exert a downward force upon the connector 30 to facilitate extraction of the connector 30 and the item 20.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for coating a plurality of items, the system comprising:
- a tank unit to prepare the plurality of items for painting;
- a painting unit to paint the plurality of items;
- a drying unit to dry the plurality of items; and
- an item conveyer to convey the plurality of items through the system as a flow of single items, the item conveyer including:
  - a plurality of item carriers to detachably secure ones of the plurality of items, each item carrier comprising:
    - a plate to cover a portion of the tank unit, the plate having a pair of tabs disposed on opposing sides of the plate;
    - a receptacle to secure a respective item of the plurality of items; and
    - an insulator to electrically isolate the item from the tank unit, wherein the plurality of item carriers cover the tank unit to reduce evaporation; and
  - a transfer rail assembly having a series of slots, respective ones of the slots being configured to engage corresponding ones of the tabs.

2. The system according to claim 1, wherein the item conveyor further includes:
- a walking beam device to advance the flow of single items through the system in a series of incremental steps, the walking beam device comprising:
  - a step rail assembly to engage and locate a subset of the plurality of item carriers at respective steps of the series of incremental steps;
  - a lift actuator to actuate the transfer rail assembly, wherein the subset of the plurality of item carriers is engaged by the transfer rail assembly and disengaged from the step rail assembly; and
  - a shift actuator to advance the transfer rail assembly to a next incremental step in the series of incremental steps.

3. The system according to claim 1, wherein the item conveyor further includes:
- a tank transfer device to detachably engage ones of the plurality of item carriers and transfer the ones of the plurality of item carriers from a first tank of the tank unit to a second tank of the tank unit.

4. The system according to claim 3, wherein the item conveyor further includes:
- a weir hop device to detachably engage ones of the plurality of item carriers and transfer the ones of the plurality of item carriers from a first tank section of the first tank to a second tank section of the first tank, wherein the first tank section and the second tank section are separated by a weir.

5. The system according to claim 1, further comprising:
- a unloading device to remove ones of the plurality of items from a respective item carriers of the plurality of item carriers.

6. The system according to claim 5, wherein the unloading device further comprises:
- a release actuator to disengage ones of the plurality of items from the respective item carriers; and
- a gripper device controlled to grip an unreleased item of the plurality of items and exert a downward force upon the unreleased item.

7. An apparatus for coating a plurality of items, the apparatus comprising:
- tank means for chemically preparing the plurality of items for painting;
- means for painting the plurality of items;
- means for drying the plurality of items; and
- means for conveying the plurality of items through the system as a flow of single items, the means for conveying including:
  - a plurality of means for detachably securing ones of the plurality of items, each means for detachably securing comprising:
    - a cover means to cover a portion of the tank means, the cover means having a pair of tabs disposed on opposing sides;
    - a receptacle means to secure a respective item of the plurality of items; and
    - an insulating means to electrically isolate the item from the tank means, wherein the plurality of item carrying means cover the tank means to reduce evaporation; and a transfer rail means having a series of slots, respective ones of the slots being configured to engage corresponding ones of the tabs.

8. The apparatus according to claim 7, the means for conveying further including:

means for advancing the plurality of items in a flow of single items through the system in a series of incremental steps, the means for advancing comprising:

means for engaging and locating the means for detachably securing at respective steps of the series of incremental steps;

means for raising the means for transferring; and means for advancing the means for transferring to a next incremental step in the series of incremental steps.

9. The apparatus according to claim 7, the means for conveying the plurality of items further including:

a second means for transferring to detachably engage the means for detachably securing and transfer the means for detachably securing from a first tank means of the means for chemically preparing to a second tank means of the means for chemically preparing.

10. The apparatus according to claim 7, the means for conveying the plurality of items further including:

a third means for transferring to detachably engage the means for detachably securing and transfer the means for detachably securing from a first tank section means of the means for chemically preparing to a second tank section means of the means for chemically preparing, wherein the first tank section means and the second tank section means are separated by a weir.

11. The apparatus according to claim 7, further comprising:

means for unloading ones of the plurality of items from a respective means for detachably securing.

12. The apparatus according to claim 11, wherein the means for unloading further comprises:

means for releasing ones of the plurality of items from the respective means for detachably securing; and means for gripping an unreleased item of the plurality of items and exerting a downward force upon the unreleased item.

* * * * *